US006434899B1

(12) United States Patent
Fortin et al.

(10) Patent No.: US 6,434,899 B1
(45) Date of Patent: Aug. 20, 2002

(54) FIRE RESISTANT DOOR EDGE CONSTRUCTION COMPRISING A STILE WITH GROOVE, HIGH DENSITY STRIP IN THE GROOVE, AN INTUMESCENT STRIP SEAL, COVERED BY AN EDGE LIPPING

(75) Inventors: Andre Fortin, Lennoxville (CA); Leo F. Juhl, Nykoebing Mors (DK)

(73) Assignee: Skamol A/S (DK)

( * ) Notice: Subject to any disclaimer, the term of this patent is extended or adjusted under 35 U.S.C. 154(b) by 0 days.

(21) Appl. No.: 09/803,010

(22) Filed: Mar. 12, 2001

(51) Int. Cl.[7] ..... E04C 2/00

(52) U.S. Cl. ..... 52/232; 52/210; 52/745.15; 52/784.11; 49/501

(58) Field of Search ..... 52/204.1, 210, 52/232, 213, 784.11, 783.13, 717.01, 745.15; 49/501

(56) References Cited

U.S. PATENT DOCUMENTS

| | | | | |
|---|---|---|---|---|
| 3,566,541 | A | 3/1971 | Coulter | 49/475.1 |
| 3,955,330 | A | 5/1976 | Wendt | 52/204 |
| 4,104,828 | A | 8/1978 | Naslund et al. | 49/399 |
| 4,159,302 | A | 6/1979 | Greve et al. | 264/333 |
| 4,246,304 | A | 1/1981 | Dixon | 428/35 |
| 4,343,127 | A | 8/1982 | Greve et al. | 52/784.11 |
| 4,364,987 | A | 12/1982 | Goodwin | 428/192 |
| 4,424,653 | A | 1/1984 | Heinen | 52/213 |
| 4,485,601 | A | 12/1984 | De Boel | 52/232 |
| 4,489,121 | A | 12/1984 | Luckanuck | 428/192 |
| 4,649,089 | A | 3/1987 | Thwaites | 428/913 |
| 4,695,494 | A | 9/1987 | Fowler, Jr. et al. | 428/71 |
| 4,748,771 | A | 6/1988 | Lehnert et al. | 49/399 |
| 4,811,538 | A | 3/1989 | Lehnert et al. | 52/455 |
| 4,819,383 | A | 4/1989 | McKann et al. | 49/501 |
| 4,839,223 | A | 6/1989 | Tschudin-Mahrer | 428/317.1 |
| 4,931,339 | A | 6/1990 | Malcolm-Brown | 428/71 |
| 4,963,403 | A | 10/1990 | Roberts et al. | 428/31 |
| 5,020,292 | A | 6/1991 | Strom et al. | 52/309.9 |
| 5,155,959 | A | 10/1992 | Richards et al. | 52/455 |
| 5,171,366 | A | 12/1992 | Richards et al. | 106/772 |
| 5,172,452 | A | 12/1992 | Brown | 16/387 |
| 5,279,087 | A | 1/1994 | Mann | 52/232 |
| 5,305,577 | A | 4/1994 | Richards et al. | 52/783.13 |
| 5,347,780 | A | 9/1994 | Richards et al.. | 52/204.1 |
| 5,501,045 | A | 3/1996 | Wexler | 52/232 |
| 5,522,195 | A | 6/1996 | Bargen | 52/455 |
| 5,565,274 | A | 10/1996 | Perrone, Jr. et al. | 428/457 |

(List continued on next page.)

FOREIGN PATENT DOCUMENTS

| | | |
|---|---|---|
| CA | 1174903 | 9/1984 |
| CA | 1217680 | 2/1987 |
| CA | 2067806 | 4/1999 |
| DE | 3720287 A1 | 1/1989 |
| EP | 0 344 964 | 12/1989 |
| FR | 76 36790 | 7/1977 |
| GB | 2 019 472 A | 10/1979 |
| GB | 2 051 192 A | 1/1981 |
| GB | 2 070 114 A | 12/1981 |
| GB | 2 085 514 A | 4/1982 |
| GB | 2 092 241 A | 8/1982 |
| GB | 2 148 993 A | 6/1985 |
| GB | 2 198 775 A | 6/1988 |
| GB | 2 287 740 A | 9/1995 |
| GB | 2 317 914 A | 4/1998 |
| NL | 7613604 | 6/1977 |
| WO | WO 99/22107 | 5/1999 |

*Primary Examiner*—Carl D. Friedman
*Assistant Examiner*—Naoko Slack
(74) *Attorney, Agent, or Firm*—Nixon & Vanderhye P.C.

(57) ABSTRACT

A fire resistant door edge construction composed of an incombustible door stile including an intumescent seal intimately fixed in a groove in the stile, over a rigid strip of high density material located in the base of the groove for anchoring hinge screws.

42 Claims, 5 Drawing Sheets

U.S. PATENT DOCUMENTS

| | | | | |
|---|---|---|---|---|
| 5,798,010 | A | | 8/1998 | Richards et al. ..... 156/39 |
| 5,816,017 | A | | 10/1998 | Hunt et al. ..... 52/784.11 |
| 5,916,077 | A | | 6/1999 | Tang ..... 49/501 |
| 5,943,824 | A | | 8/1999 | Tatara ..... 49/462 |
| 5,970,670 | A | | 10/1999 | Hoffman ..... 52/232 |
| 6,102,995 | A | | 8/2000 | Hutchings et al. ..... 106/18.15 |
| 6,115,976 | A | * | 9/2000 | Gomez ..... 52/232 |
| 6,119,411 | A | * | 9/2000 | Gil et al. ..... 109/80 |

* cited by examiner

FIRE RESISTANT DOOR EDGE CONSTRUCTION COMPRISING A STILE WITH GROOVE, HIGH DENSITY STRIP IN THE GROOVE, AN INTUMESCENT STRIP SEAL, COVERED BY AN EDGE LIPPING

BACKGROUND AND SUMMARY OF THE INVENTION

It is known to incorporate an intumescent seal within the stile or frame of fire resistant doors. Typically, the door stile includes an inner strip of mineral material, such as a cast gypsum mixture, an intermediate intumescent strip seal, and an outer strip or band of hardwood or the like. When subjected to elevated temperatures, as experienced in a fire, the intumescent strip seal expands to seal the air space between the door frame and the door.

One problem with fire resistant doors has been the screw holding ability of such stile constructions, particularly along the inner edge of the door stile where the door hinges are secured. It is critical that the screw-holding capacity of the stile remain intact under the highest temperatures in a fire situation in order for the intumescent seal to function properly and keep the door fixed to the frame.

This invention provides a new high density strip configuration that substantially increases the screw-holding capacity of the door stile, achieving high ratings of screw withdrawal according to the standard NWWDTA TM-10 Test. To achieve such a rating, the present invention, in one exemplary embodiment, locates the intumescent seal strip within an edge groove formed in the door stile, after having first inserted a strip of high density material in the base of the groove. This strip of high density material anchors the hinge screws and is itself protected against flaming by the inorganic material of the stile that surrounds the high density strip on three sides, and by the intumescent strip that closes the groove under the outer hardwood edge or lipping.

The door stile construction may be formed by fixing the strip of high density material and the intumescent strip seal within a machined groove in the stile, or by casting the door stile around the high density strip and the strip seal. In the latter case, the intumescent strip seal is preferably laminated to the high density strip, and the latter is slightly wider than the intumescent strip seal in order to firmly lock the high density strip within the stile.

Accordingly, in its broader aspects, the invention relates to a fire resistant door edge construction comprising a stile having a groove formed therein, opening along one edge of the stile, a high density strip located in and extending along the groove; an intumescent strip seal adjacent the high density strip; and an edge lipping extending along the one edge, covering the intumescent strip seal.

In another aspect, the invention relates to a fire resistant door edge construction comprising a stile having a high density strip embedded within an edge of the stile, the high density strip partially surrounded by the stile; an intumescent strip seal adjacent the high density strip; and an edge lipping extending along the one edge, covering the intumescent strip seal.

In still another aspect, the invention relates to a fire resistant door comprising a door frame, a core, and veneer panels or plywood doorskins covering front and back faces of the door frame; the door frame including a stile extending along an inner edge of the door frame, the stile having a groove formed therein, opening along one edge of the stile, a high density strip and located in and extending along the groove; an intumescent strip seal adjacent the high density strip; and an edge lipping extending along the one edge, covering the intumescent strip seal.

In still another aspect, the invention relates to a fire resistant door comprising a door frame, a core, and veneer panels or plywood doorskins covering front and back faces of the door frame; the door frame including a stile extending along an inner edge of the door frame, the stile having a high density strip embedded within an edge of the stile, the high density strip partially surrounded by the stile; an intumescent strip seal adjacent the high density strip; and an edge lipping extending along the one edge, covering the intumescent strip seal.

In still another aspect, the invention relates to a method of forming a door edge comprising:

a) providing a laminate comprising a strip of high density material and an intumescent strip seal, each having a predetermined width, wherein the width of the strip of high density material is greater than the width of the intumescent strip seal; and b) casting a stile member about the laminate such that a face of the intumescent strip seal lies substantially flush with one edge of the stile member; and c) covering the one edge with an edge lipping.

In still another aspect, the invention relates to a method of forming a door edge comprising:

a) providing a strip of high density material having a base portion with a width greater than a remaining portion;

b) casting a stile member about the strip of high density material such that one face of the high density material is substantially flush with one edge of the stile member; and c) covering the one edge with a laminate comprising an intumescent strip seal and an edge lipping extending along substantially the entire length of the one edge.

Other objects and advantages of the subject invention will become apparent from the detailed description that follows.

DETAILED DESCRIPTION OF THE DRAWINGS

Figure 1:
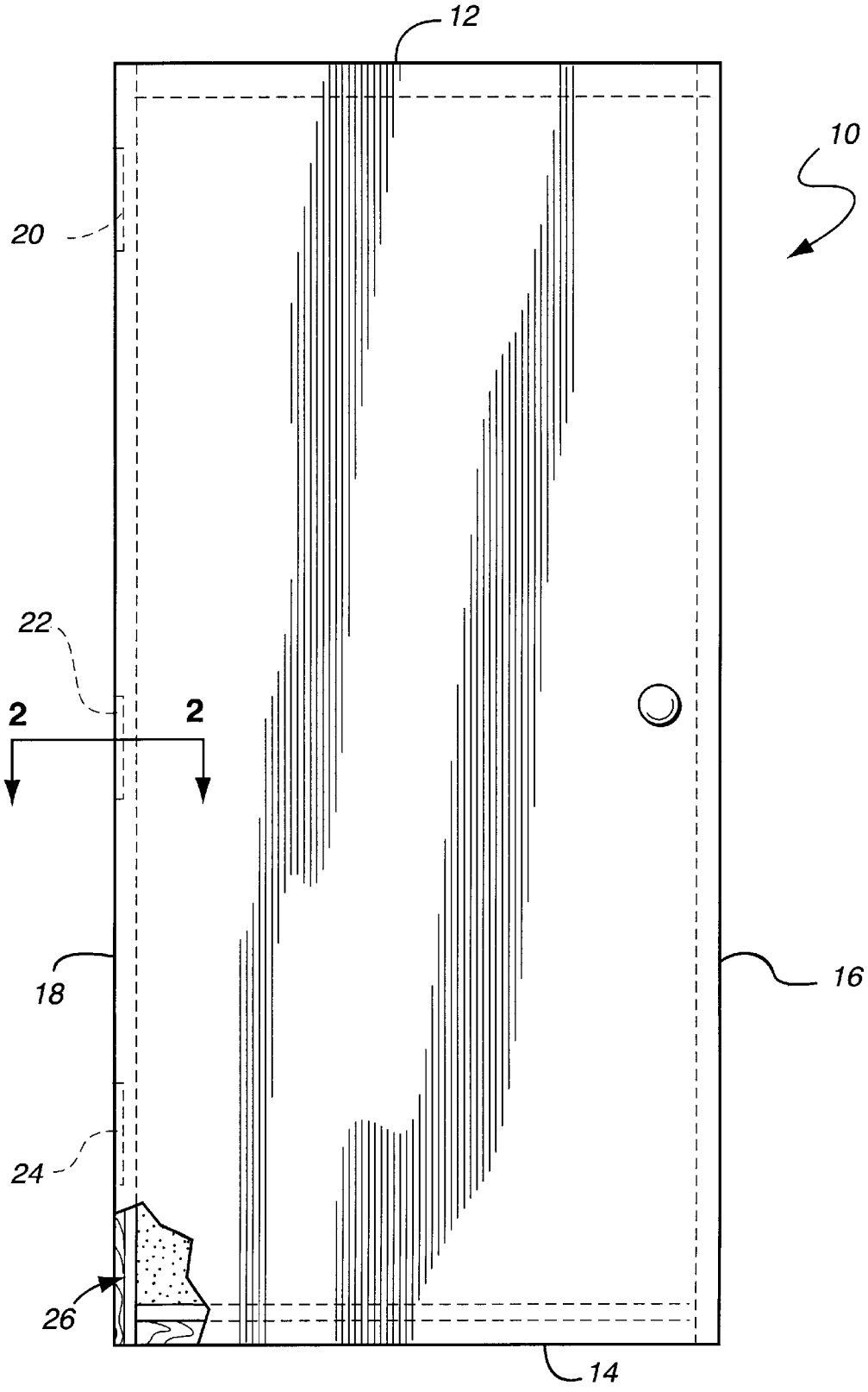
FIG. 1 is a front elevation of a door construction in accordance with the invention, partially broken away to show the internal door stile along the inner edge of the door.

With reference to FIG. 1, the door 10 includes top and bottom edges 12,14, an outer edge 16 and an inner edge 18. The inner edge typically incorporates hinges, shown in phantom in FIG. 1 at 20, 22 and 24. The number and location of the hinges along the inner edge 18 may, of course, vary as desired.

Of particular interest in this invention is the door stile 26 that typically extends about the two sides of the door. The stile 26 may be constructed of a block of conventional incombustible mineral compound material (for example, a cast mineral mixture) having a density of at least 800 kgs/M$^3$. The material may be reinforced with fiber material to provide greater strength against impact. Along the inner edge 18, the door stile 26 is formed with an edge groove 28 (best seen in FIG. 3) having a base 30 and a pair of side walls 32, 34, with the groove open along the outer edge of the stile, i.e., that edge facing the door frame to which the door is hinged. The block 26 may vary in width to provide additional surface for accepting hinge screws and/or to add strength to the door. A typical dimension for the stile would be 1½"×1½"×84" (38 mm×38mm×2150 mm).

A high density strip 36, preferably high density fiberboard, is located in the groove 28, engaged with the base 30 and side walls 32, 34. Strip 36 may have a width of about ⅞" (22 mm), and a thickness of about ⅜" (10 mm). Alternatively, the high density strip may be a reinforced, high density mineral strip. In either case, the strip preferably has a density of at least 1050 kgs/M$^3$. A conventional intumescent strip seal 38 is then placed in the groove, engaged or laminated with the strip 36, with the outer face 40 of the strip seal substantially flush with the edge surface 42 of the stile. An edge strip or lipping 44 of hardwood or other suitable material (preferably with a density of at least 550 kgs/M$^3$) extends along the entire length of the edge 42, completing the edge construction. Typically, veneer panels or plywood doorskins 46, 48 are added to the front and back faces of the door, covering the sides of the stiles and a low density mineral core 50.

Figure 2:
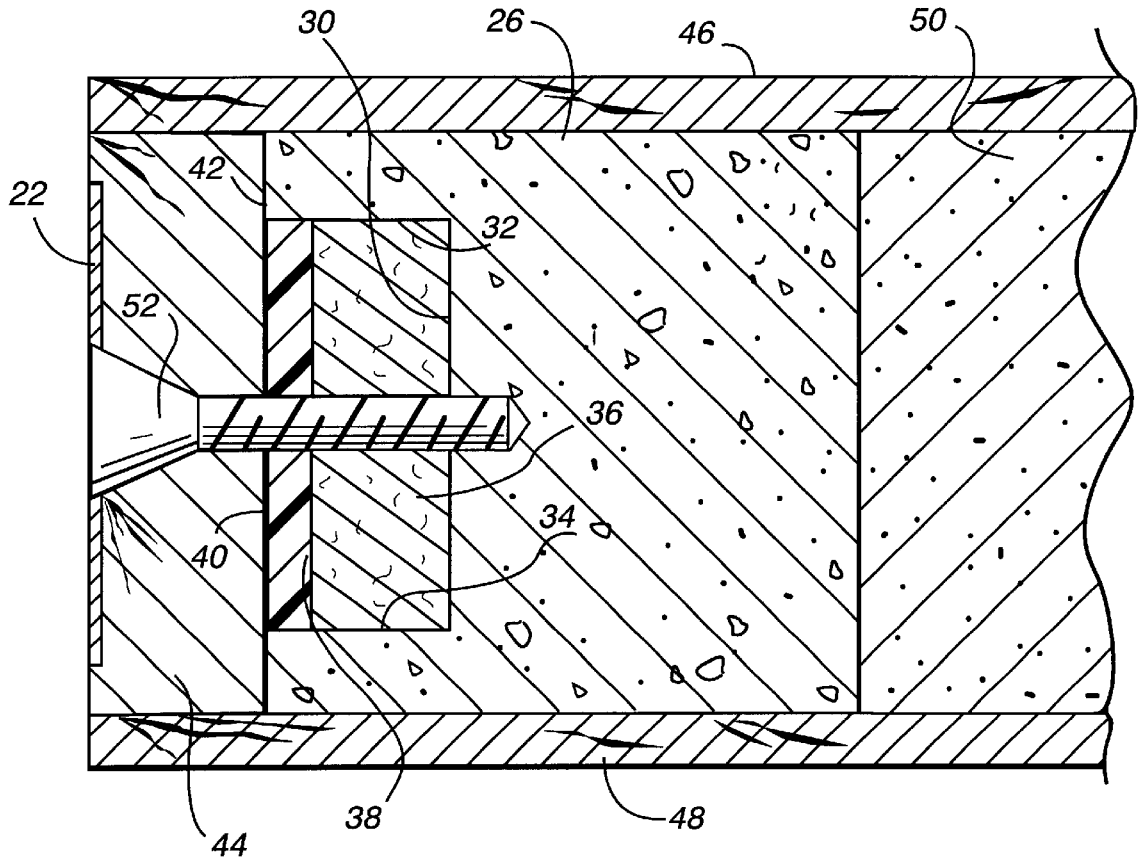
FIG. 2 is an enlarged section view taken along the line 2—2 of FIG. 1.

As best seen in FIG. 2, hinge screws 52 (one shown) pass through the hinge 22, hardwood edge strip or lipping 44, intumescent strip seal 38 and into the high density fiberboard strip 36 that securely anchors the screw to the stile.

Figure 3:
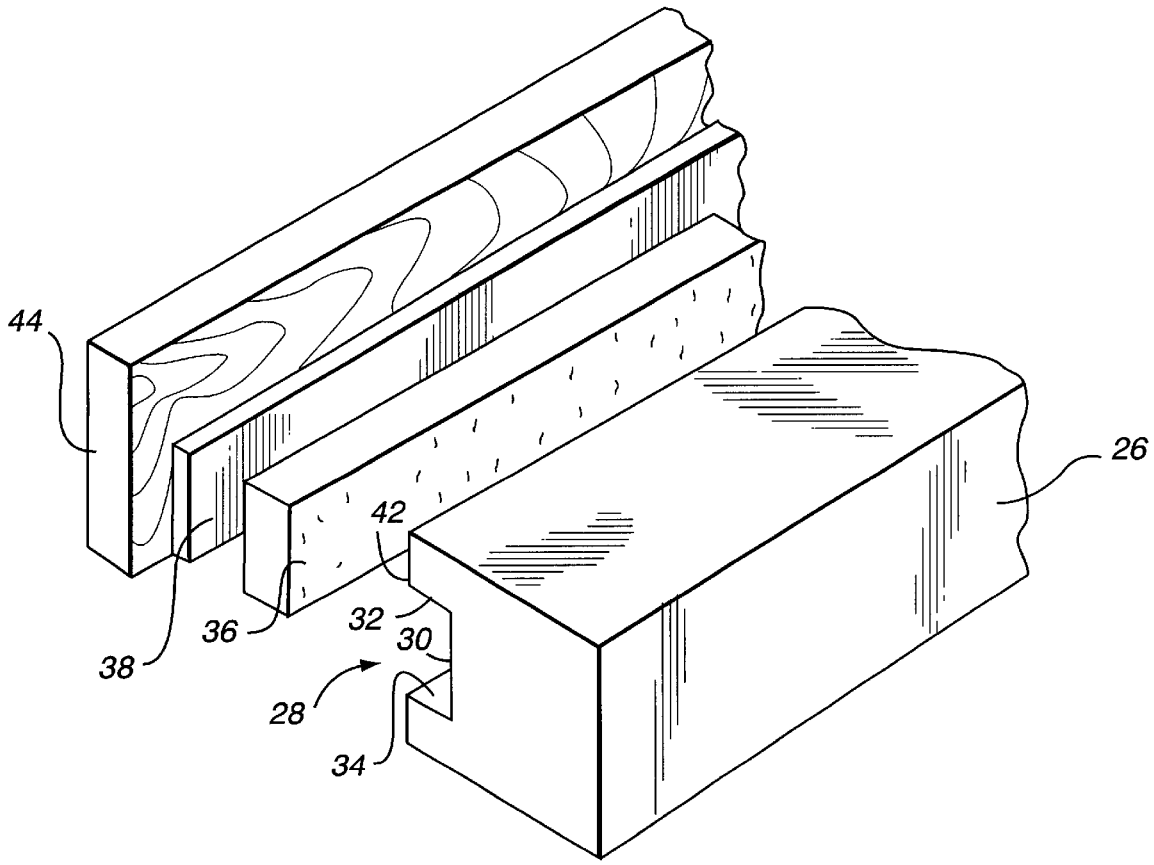
FIG. 3 is a partial perspective view of the door stile construction of FIG. 2, in exploded form.
Figure 4:
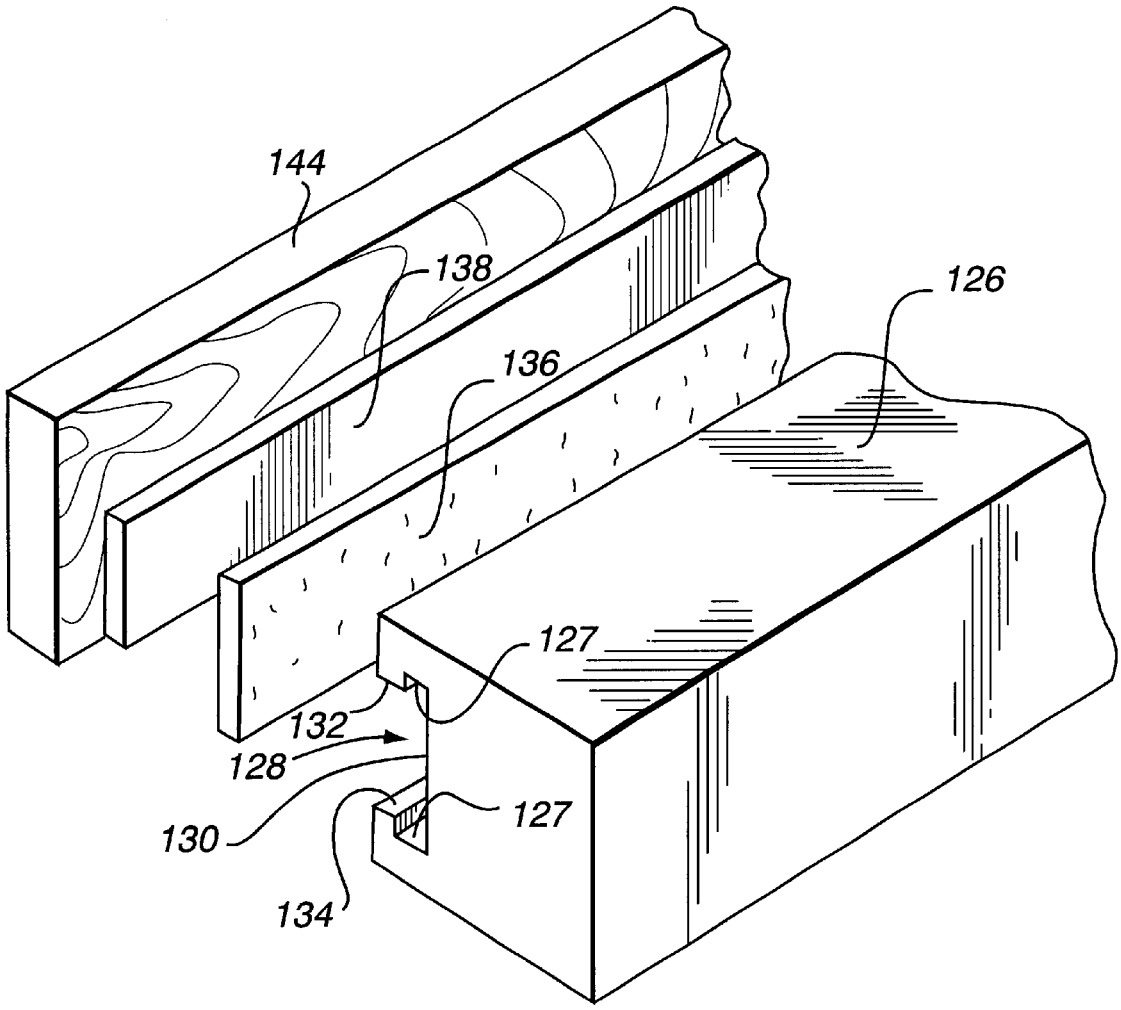
FIG. 4 is a partial perspective view similar to FIG. 3 but in accordance with an alternative embodiment of the invention.

In an alternative arrangement illustrated in FIG. 4, similar reference numerals, but with the prefix "1" added, are used for components corresponding to those in FIGS. 1–3. In this embodiment, a high density fiberboard strip 136 is laminated to a conventional intumescent strip seal 138, with the strip 136 having a width greater than the strip seal 138. The stile or mineral block 126 is cast about the fiberboard strip 136 and strip seal 138, thus creating an undercut or slot 127 in the cast block, at the base of the "groove" 128. Note that the exploded view in FIG. 4 is for clarity only since the strip 136 cannot be removed from the stile 126 after casting, especially in view of the undercut 127. Otherwise, the overall arrangement is similar to that shown in FIGS. 1–3. This arrangement positively locks the high density strip 136 in place, so that the latter is not pulled forward or unscrewed by the weight of the door at the hinge locations, and particularly at the top hinge 20 where most of the stress occurs.

Figure 5:
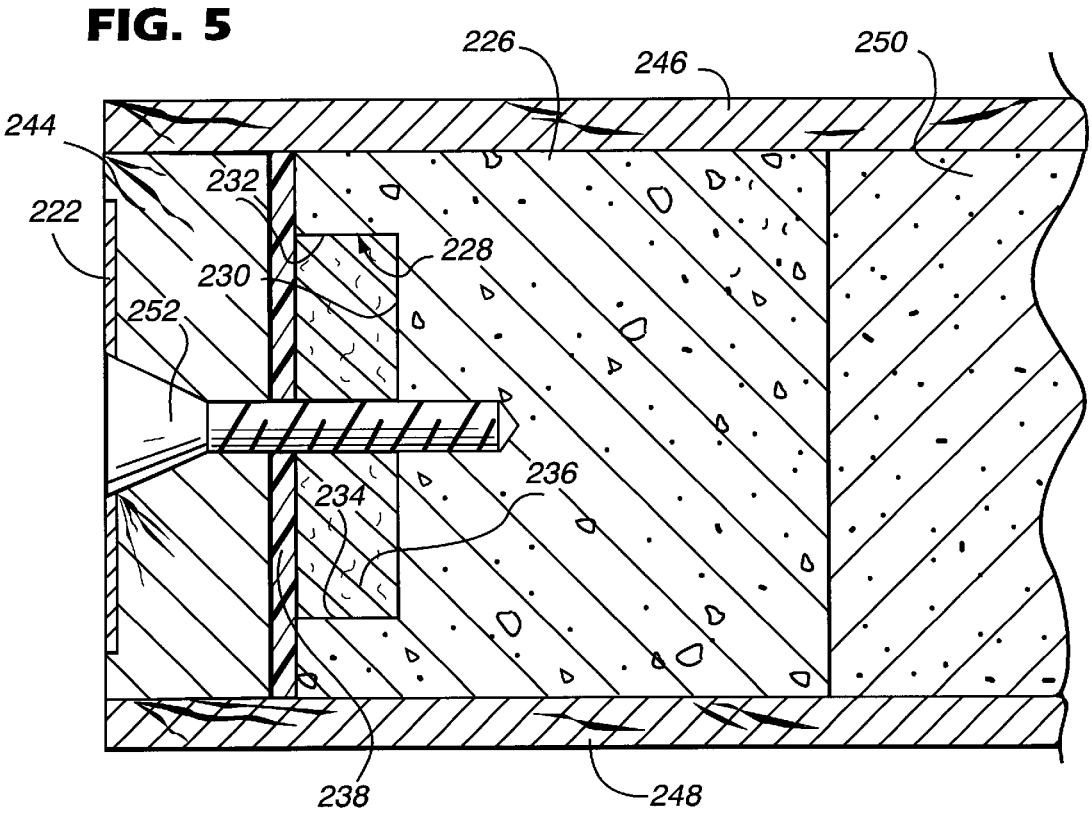
FIG. 5 is a section similar to FIG. 2 but showing an alternative embodiment of the invention.

FIG. 5 shows a section view of a door edge construction in accordance with another exemplary embodiment of the invention. Reference numerals similar to those used in FIG. 2 are used in FIG. 5 to designate corresponding components. Thus, the door edge construction includes a stile 226 formed with a groove 228 extending along one edge of the stile, having a base 230, and side walls 232, 234. In this embodiment, the high density strip 236 fills the groove 228 so that a face of the high density strip is flush with the edge of the stile. An intumescent strip seal 238 is laminated to the inside face of the edge strip or lipping 244, such that the lipping and intumescent seal cover the face of the high density strip and the edge of the stile. The screw 252 extends through the hinge 222, lipping member 244, intumescent seal 238, high density strip 236, terminating in the stile 226.

Figure 6:
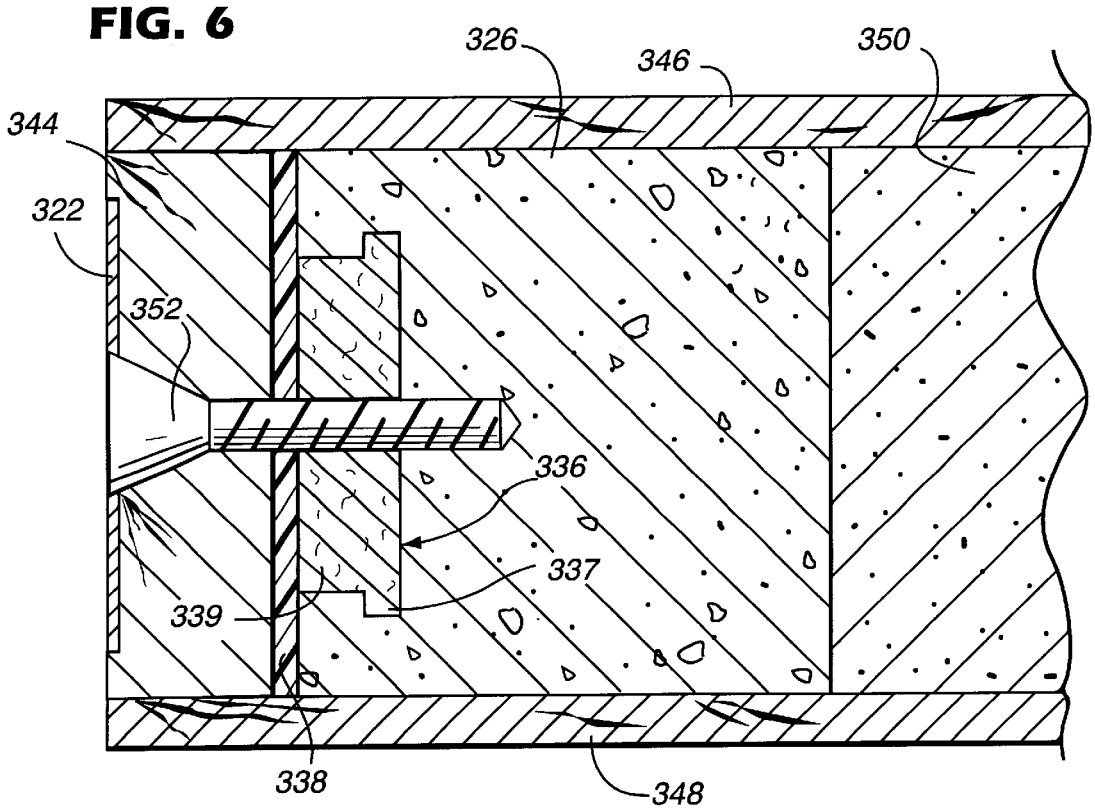
FIG. 6 is a section similar to FIGS. 2 and 5 but showing still another embodiment of the invention.

With reference to FIG. 6, still another embodiment of the invention is illustrated. Similar reference numerals, but with the prefix "3" added are used to designate corresponding components. In this embodiment, the stile 326 is cast about the high density strip 336. In this embodiment, the high density 336 includes a base portion 337 having a width greater than a remaining portion 339 of the high density strip, such that the stile 326 partially surrounds, and locks the high density strip 336 in place within the stile. Similar to the embodiment shown in FIG. 5, the intumescent strip seal 338 is laminated to the edge strip or lipping 334 and this laminate is applied over the edge of the stile, covering the high density strip 336 and edge surface of the stile 326.

While the stile constructions described above is particularly useful along the inner edge 18 of the door, it will be appreciated that it could also be used along the remaining edges 12 and 16, noting that intumescent strip seals are not typically employed along the bottom edge 14 of fire resistant doors.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fire resistant door edge construction comprising a stile having a groove formed therein, opening along one edge of said stile, a high density strip located in and extending along the groove; an intumescent strip seal adjacent said high density strip; and an edge lipping extending along said one edge, covering said intumescent strip seal.

2. The fire resistant door edge construction of claim 1 wherein said stile is comprised of a fiber reinforced mineral material with a density of at least 800 kgs/M$^3$.

3. The fire resistant door edge construction of claim 1 wherein said high density strip comprises high density fiberboard or reinforced high density mineral strip having a density of at least 1050 kgs/M$^3$.

4. The fire resistant door edge construction of claim 1 wherein said edge lipping comprises a hardwood.

5. The fire resistant door edge construction of claim 1 wherein said edge lipping has a density of at least 550 kgs/M$^3$.

6. The fire resistant door edge construction of claim 1 wherein said stile is comprised of a fiber reinforced mineral material with a density of 800 kgs/M$^3$ or more; wherein said high density strip comprises high density fiberboard having a density of at least 1050 kgs/M$^3$; and further wherein said edge lipping comprises a hardwood with a density of at least 550 kgs/M$^3$.

7. The fire resistant door edge construction of claim 1 wherein said intumescent strip seal is located in said groove.

8. The fire resistant door edge construction of claim 1 wherein said stile, lipping and intumescent strip seal have substantially equal widths.

9. A fire resistant door edge construction comprising a stile having a high density strip embedded within an edge of the stile, said high density strip partially surrounded by said stile; an intumescent strip seal adjacent said high density strip; and an edge lipping extending along said one edge, covering said intumescent strip seal.

10. The fire resistant door edge construction of claim 9 wherein said high density strip has a greater width than said intumescent strip seal.

11. The fire resistant door edge construction of claim 9 wherein said high density strip includes a base portion with a width greater than a remaining portion thereof.

12. The fire resistant door edge construction of claim 11 wherein said stile, lipping and intumescent strip seal have substantially identical widths.

13. The fire resistant door edge construction of claim 9 wherein said stile is comprised of a fiber reinforced mineral material with a density of at least 800 kgs/$M^3$.

14. The fire resistant door edge construction of claim 9 wherein said high density strip comprises high density fiberboard or reinforced high density mineral strip having a density of at least 1050 kgs/$M^3$.

15. The fire resistant door edge construction of claim 9 wherein said edge lipping comprises a hardwood.

16. The fire resistant door edge construction of claim 7 wherein said edge lipping has a density of at least 550 kgs/$M^3$.

17. The fire resistant door edge construction of claim 9 wherein said stile is comprised of a fiber reinforced mineral material with a density of about 800 kgs/$M^3$; said high density strip comprises high density fiberboard having a density of at least 1050 kgs/$M^3$; and wherein said edge lipping comprises a hardwood having a density of at least 550 kgs/$M^3$.

18. A fire resistant door comprising a door frame, a core, and veneer panels or plywood doorskins covering front and back faces of the door frame; said door frame including a stile extending along an inner edge of the door frame, said stile having a groove formed therein, opening along one edge of said stile, a high density strip and located in and extending along the groove; an intumescent strip seal adjacent said high density strip; and an edge lipping extending along said one edge, covering said intumescent strip seal.

19. The fire resistant door edge construction of claim 18 wherein said intumescent strip seal is located in said groove.

20. The fire resistant door edge construction of claim 18 wherein said stile, lipping and intumescent strip seal have substantially equal widths.

21. The fire resistant door edge construction of claim 18 wherein said stile is comprised of a fiber reinforced mineral material with a density of 800 kgs/$M^3$ or more.

22. The fire resistant door edge construction of claim 18 wherein said high density strip comprises high density fiberboard or reinforced high density mineral strip having a density of at least 1050 kgs/$M^3$.

23. The fire resistant door edge construction of claim 18 wherein said edge lipping comprises a hardwood.

24. The fire resistant door edge construction of claim 18 wherein said edge band has a density of at least 550 kgs/$M^3$.

25. The fire resistant door edge construction of claim 18 wherein said stile is comprised of a fiber reinforced mineral material with a density of at least 800 kgs/$M^3$; wherein said high density strip comprises high density fiberboard having a density of at least 1050 kgs/$M^3$; and further wherein said edge lipping comprises a hardwood with a density of at least 550 kgs/$M^3$.

26. A fire resistant door comprising a door frame, a core, and veneer panels or plywood doorskins covering front and back faces of the door frame; said door frame including a stile extending along an inner edge of the door frame, said stile having a high density strip embedded within an edge of the stile, said high density strip partially surrounded by said stile; an intumescent strip seal adjacent said high density strip; and an edge lipping extending along said one edge covering said intumescent strip seal.

27. The fire resistant door edge construction of claim 26 wherein said high density strip has a greater width than said intumescent strip seal.

28. The tire resistant door edge construction of claim 26 wherein said high density strip includes a base portion with a width greater than a remaining portion thereof.

29. The fire resistant door edge construction of claim 28 wherein said stile, lipping and intumescent strip seal have substantially identical widths.

30. The fire resistant door edge construction of claim 26 wherein said stile is comprised of a fiber reinforced mineral material with a density of at least 800 kgs/$M^3$.

31. The fire resistant door edge construction of claim 26 wherein said high density strip comprises high density fiberboard or reinforced high density mineral strip having a density of at least 1050 kgs/$M^3$.

32. The fire resistant door edge construction of claim 26 wherein said edge lipping comprises a hardwood.

33. The fire resistant door edge construction of claim 26 wherein said edge lipping has a density of at least 550 kgs/$M^3$.

34. The fire resistant door edge construction of claim 26 wherein said stile is comprised of a fiber reinforced mineral material with a density of about 800 kgs/$M^3$; said high density strip comprises high density fiberboard having a density of at least 1050 kgs/$M^3$; and wherein said edge lipping comprises a hardwood having a density of at least 550 kgs/$M^3$.

35. A method of forming a door edge comprising:

a) providing a laminate comprising a strip of high density material and an intumescent strip seal, each having a predetermined width, wherein the width of said strip of high density material is greater than the width of said intumescent strip seal; and b) casting a stile member about said laminate such that a face of said intumescent strip seal lies substantially flush with one edge of said stile member; and c) covering said one edge with an edge lipping.

36. The method of claim 35 wherein said stile is comprised of a fiber reinforced mineral material with a density of at least 800 kgs/$M^3$.

37. The method of claim 35 wherein fiber reinforced mineral material is reinforced with a glass-fiber material.

38. The method of claim 35 wherein said high density strip comprises high density fiberboard or reinforced high density mineral strip having a density of at least 1050 kgs/$M^3$.

39. The method of claim 35 wherein said edge lipping comprises a hardwood.

40. The method of claim 35 wherein said edge lipping has a density of at least 550 kgs/$M^3$.

41. The method of claim 35 wherein said stile is comprised of a fiber reinforced mineral material with a density of at least 800 kgs/$M^3$; and wherein said high density strip comprises high density fiberboard or reinforced high density mineral strip having a density of at least 1050 kgs/$M^3$; and wherein said edge lipping comprises a hardwood having a density of at least 550 kgs/$M^3$.

42. A method of forming a door edge comprising:

a) providing a strip of high density material having a base portion with a width greater than a remaining portion;

b) casting a stile member about said strip of high density material such that one face of said high density material is substantially flush with one edge of the stile member; and c) covering said one edge with a laminate comprising an intumescent strip seal and an edge lipping extending along substantially the entire length of said one edge.

* * * * *